US006049766A

United States Patent [19]

Laroche

[11] Patent Number: 6,049,766

[45] Date of Patent: Apr. 11, 2000

[54] TIME-DOMAIN TIME/PITCH SCALING OF SPEECH OR AUDIO SIGNALS WITH TRANSIENT HANDLING

[75] Inventor: Jean Laroche, Aptos, Calif.

[73] Assignee: Creative Technology Ltd., Singapore, Singapore

[21] Appl. No.: 08/745,929

[22] Filed: Nov. 7, 1996

[51] Int. Cl.[7] ..... G10L 3/02; G10L 9/00

[52] U.S. Cl. ..... 704/216; 704/503

[58] Field of Search ..... 704/201, 211, 704/207, 267, 500, 503, 216, 218

[56] References Cited

U.S. PATENT DOCUMENTS

| | | | |
|---|---|---|---|
| 3,816,664 | 6/1974 | Koch | 704/503 |
| 4,464,784 | 8/1984 | Agnello | 381/61 |
| 4,700,391 | 10/1987 | Leslie, Jr. et al. | 704/211 |
| 5,630,013 | 5/1997 | Suzuki et al. | 704/216 |

*Primary Examiner*—David R. Hudspeth
*Assistant Examiner*—Patrick N. Edouard
*Attorney, Agent, or Firm*—Towsend and Townsend and Crew LLP

[57] ABSTRACT

Method and apparatus for time-scaling and/or pitch shifting by discarding and/or repeating segments of a signal. The signal is stored as a series of samples in a memory where it is readable by one or more read pointers. Periodicity of segments of the signal is determined by evaluating normalized cross-correlation over a range of possible periods. Transients are detected by monitoring changes in rms signal value. To achieve time compression or time stretching, a segment is skipped/discarded whenever a maximum time-discrepancy between the current output and an ideal output is reached or a high periodicity is detected, a jump of the optimal length would not make this time discrepancy too high, and no transient is present in the segment to be skipped/discarded.

30 Claims, 10 Drawing Sheets

TIME-DOMAIN TIME/PITCH SCALING OF SPEECH OR AUDIO SIGNALS WITH TRANSIENT HANDLING

COPYRIGHT NOTICE

A portion of the disclosure of this patent document contains material which is subject to copyright protection. The copyright owner has no objection to the xerographic reproduction by anyone of the patent document or the patent disclosure in exactly the form it appears in the Patent and Trademark Office patent file or records, but otherwise reserves all copyright rights whatsoever.

APPENDIX

A source code appendix is included herewith.

BACKGROUND OF THE INVENTION

The present invention relates to audio signal processing and more particularly to time and/or pitch shifting of an audio signal.

It is desirable to modify the duration of an audio signal while retaining a natural sound or modify the pitches in an audio signal without changing the duration. One application is video synchronization. One often needs to adjust the duration of a recording to make it fit exactly the duration of the video clip without modifying the pitch. Acceptable duration discrepancies are less than 20%. On the other hand, pitch scaling is often used to slightly adjust the pitch of a recording before mixing it with other recordings.

For professional audio applications, time/pitch scaling techniques must meet high quality standards. It is also desirable to perform the necessary computations in real time.

Time-scaling and pitch-scaling are in some respects the same problem. In order to increase the pitch of a signal by 1%, one can extend the signal's duration by 1% and resample the extended signal at a rate 1% higher than the original rate.

Perhaps the simplest method of time-scaling is the splice method. Modifying the duration of a signal without altering its pitch requires that some samples be created (for time-expansion) or discarded (for time-compression). The splice method generally consists of regularly duplicating or discarding small pieces of the original signal, and using cross-fading to conceal the discontinuity caused by the duplicating or discarding operation.

Unfortunately, the splice method tends to generate conspicuous artifacts, mainly because the splice points and the duration of the discarded/duplicated segments are fixed parameters, and no optimization is permitted.

SUMMARY OF THE INVENTION

The present invention provides method and apparatus for time-scaling and/or pitch shifting by discarding and/or repeating segments of a signal. In one embodiment, the signal is stored as a series of samples in a memory where it is readable by one or more read pointers. A first read pointer corresponds to a current output sample. A second read pointer corresponds to an ideal output sample for a desired time scaling operation. A time discrepancy counter indicates the difference in position between the first read pointer and the second read pointer. Periodicity of segments of the signal is determined by evaluating normalized cross-correlation over a range of possible periods. Transients are detected by monitoring changes in rms signal value. To achieve time compression or time stretching, a segment is skipped/discarded whenever either the maximum time-discrepancy is reached or a high periodicity is detected, a jump of the optimal length would not make the time-discrepancy too high, and no transient is present in the segment to be skipped/discarded. Cross-fading is used to reduce artifacts when the segment is skipped/discarded. By favoring skipping or repeating segments with high periodicity, and disfavoring skipping or repeating segments containing transients, conspicuous artifacts are significantly reduced.

In accordance with a first aspect of the present invention, a method of compressing duration of a signal includes: evaluating periodicity of segments of said signal based on normalized cross-correlation evaluated over a range of periods, and selecting a position of a segment of said signal to be skipped. The segment is positioned within a highly periodic portion of said signal as determined by the evaluating step. The method may further include selecting a length of said segment to be skipped to correspond to a period having a maximum normalized cross-correlation as determined in the evaluating step.

In accordance with a second aspect of the present invention, a method of extending duration of a signal includes evaluating periodicity of segments of said signal based on normalized cross-correlation evaluated over a range of periods, and selecting a position of a segment of the signal to be repeated. The segment is positioned within a highly periodic portion of said signal as determined by the evaluating step. The method may further include selecting a length of said segment to be repeated to correspond to a period having a maximum normalized cross-correlation as determined in the evaluating step.

A further understanding of the nature and advantages of the invention herein may be realized by reference to the remaining portions of the specification and the attached drawings.

DESCRIPTION OF SPECIFIC EMBODIMENTS

Figure 1:
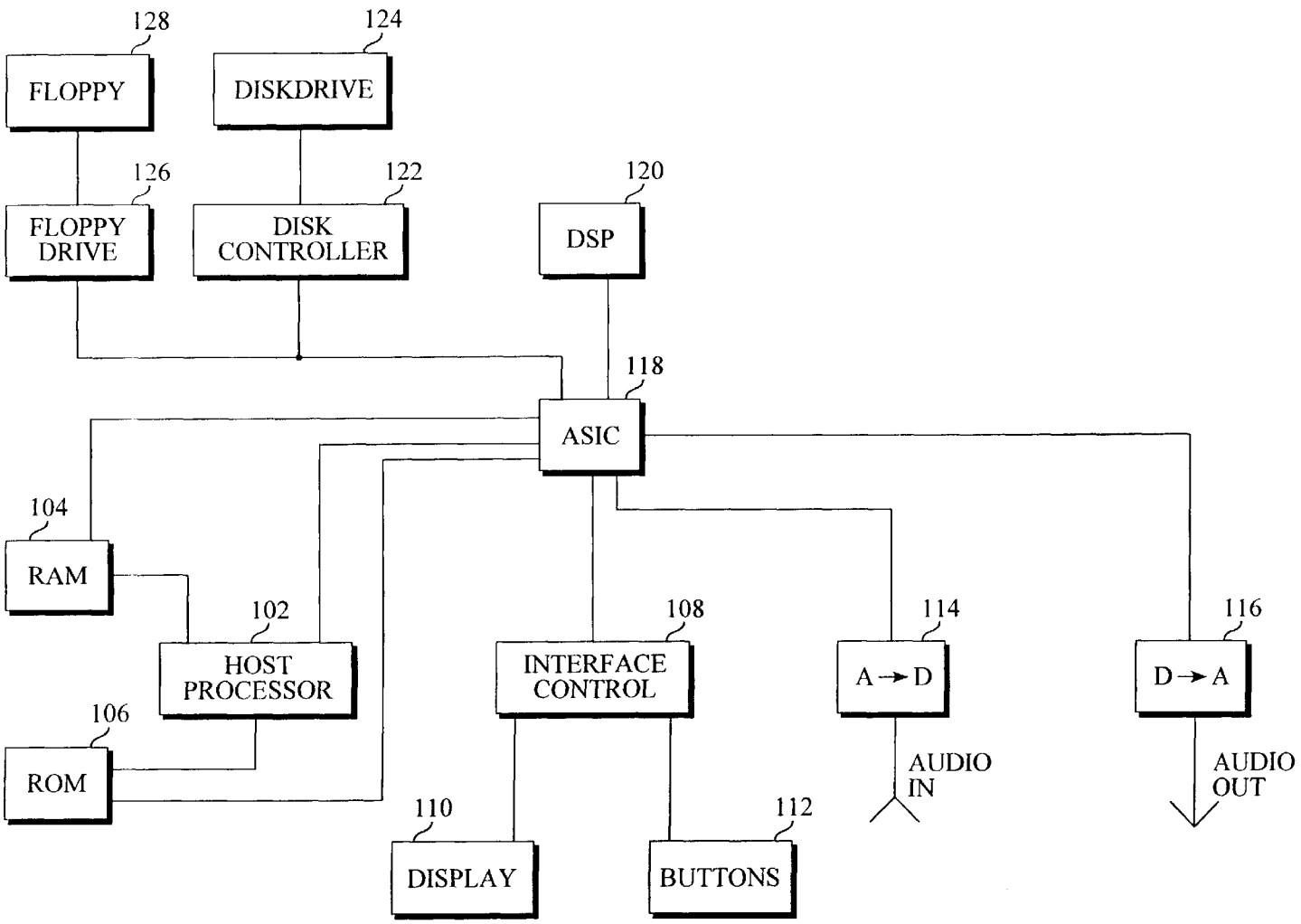
FIG. 1 depicts a signal processing system suitable for implementing the present invention.

FIG. 1 depicts a signal processing system 100 suitable for implementing the present invention. In one embodiment, signal processing system 100 captures sound samples, processes the sound samples, and plays out the processed sound samples. The present invention is, however, not limited to processing of sound samples but also may find application in processing, e.g., video signals, remote sensing data, geophysical data, etc. One particular application of signal processing system 100 is pitch modification of polyphonic sounds such as voice ensembles or multiple instrument music. Signal processing system 100 includes a host processor 102, RAM 104, ROM 106, an interface controller 108, a display 110, a set of buttons 112, an analog-to-digital (A-D) converter 114, a digital-to-analog (D-A) converter 116, an application-specific integrated circuit (ASIC) 118, a digital signal processor 120, a disk controller 122, a hard disk drive 124, and a floppy drive 126.

In operation, A-D converter 114 converts analog sound signals to digital samples. Signal processing operations on the sound samples may be performed by host processor 102 or digital signal processor 120. Sound samples may be stored on hard disk drive 124 under the direction of disk controller 122. A user may request particular signal processing operation using button set 112 and may view system status on display 110. Once sounds have been processed, they may be played out by using D-A converter 116 to convert them back to analog. The program control information for host processor 102 and DSP 120 is operably disposed in RAM 104. Long term storage of control information may be in ROM 106, on disk drive 124 or on a floppy disk 128 insertable in floppy drive 126. ASIC 118 serves to interconnect and buffer between the various operational units. DSP 120 is preferably a 50 MHz TMS320C32 available from Texas. Instruments. Host processor 102 is preferably a 68030 (?) microprocessor available from Motorola. In accordance with one embodiment of the present invention time scaling and/or pitch shifting is one application of signal processing system 100. Software to implement the present invention may be stored on a floppy disk 128, in Rom 106, on hard disk drive 124 or in RAM 104 at runtime.

Figure 2:
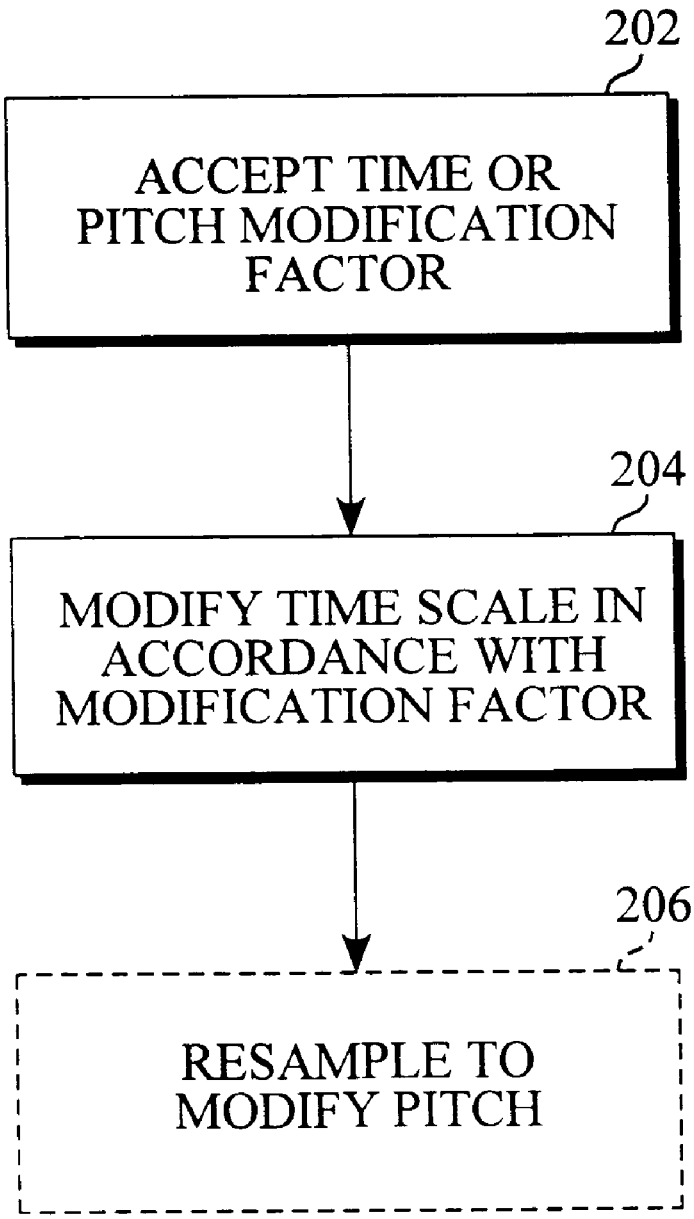
FIG. 2 is a top level flowchart describing steps of time scaling or pitch shifting a signal.

FIG. 2 is a top level flowchart describing steps of time scaling or pitch shifting a signal. At step 202, a time or pitch modification factor is accepted. A time modification factor of 1.2 would denote, for example, that a duration of the signal is to be extended, e.g., by 20% while maintaining a natural sound. A pitch modification factor of 0.8 would denote that a pitch content of the signal is to be shifted down by 20%. These factors may be directly selected by the user or by software performing higher level audio processing and/or editing tasks. At step 204, the time scale is changed in accordance with the modification factor. For pitch shifting (as opposed to time scaling), at step 206, the time scaled signal is resampled to restore its original duration. General background for time/pitch scaling is presented in J. Laroche, "Autocorrelation Method for High Quality Time/Pitch Scaling", *IEEE ASSP Workshop on Application of Signal Processing to Audio and Acoustics,* 1993, the contents of which are herein incorporated by reference for all purposes.

The present invention represents an enhancement to the so-called splice method of time scaling. In the splice method of time scaling, segments of the original. signal are repeated or discarded to force the signal to conform to the desired time scale. Cross-fading is used to conceal the effects of repeating or discarding.

Figure 3A:
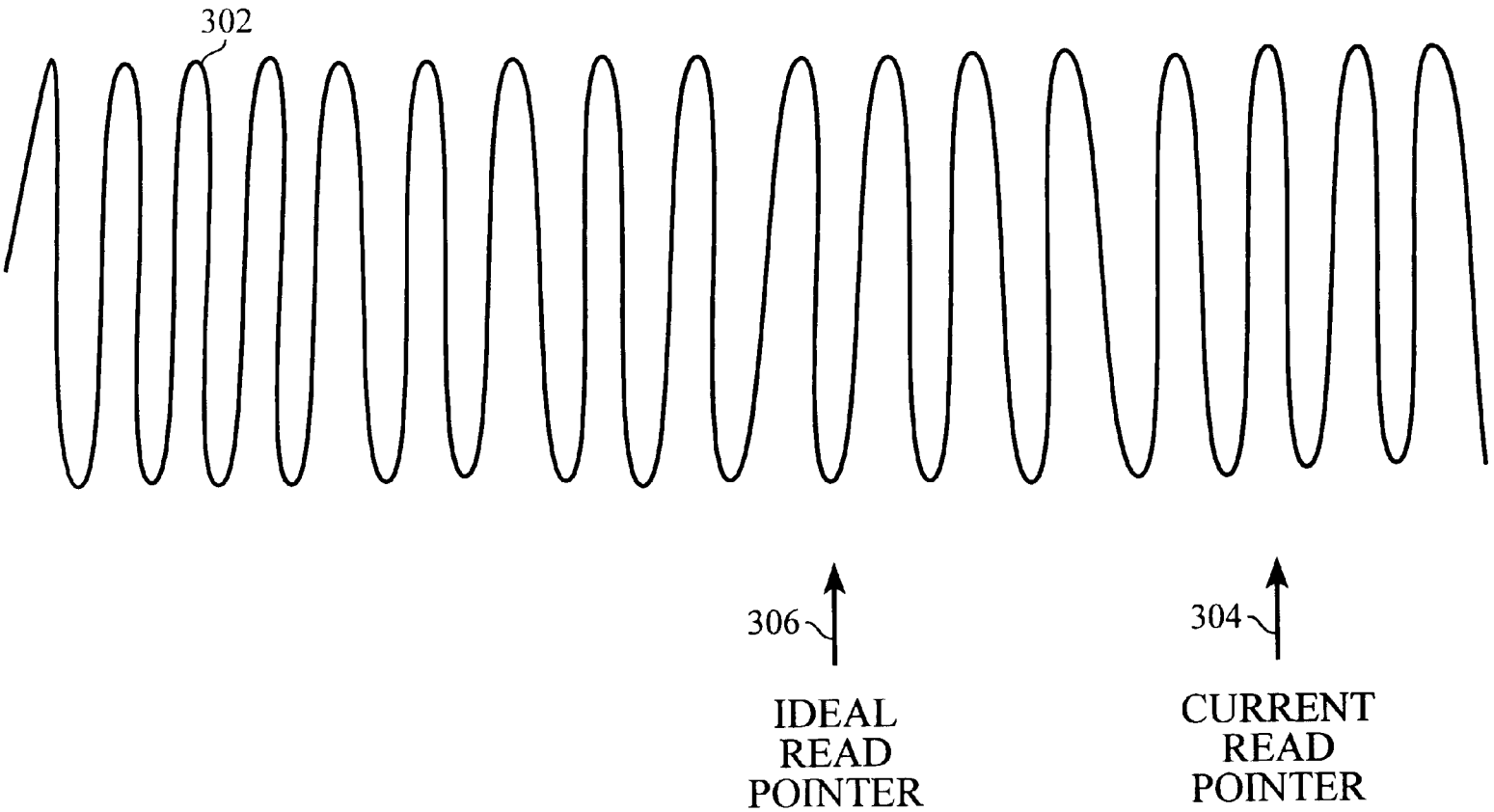
FIGS. 3A–3C depict general principles of time scaling in accordance with one embodiment of the present invention.

FIG. 3A depicts the use of read pointers in time stretching. A signal 302 is stored in memory as a sequence of samples in successive memory locations. A current read pointer 304 increments at a rate equivalent to the rate at which the signal was originally sampled. An ideal read pointer 306 increments at a rate of (1/R) times this sampling rate where R is the time scale modification factor. Since time stretching is desired, as the current read pointer is incremented, the ideal read pointer lags further and further behind.

To achieve the desired time stretching effect, segments of the signal are repeated. Selecting the position and duration of a time segment to be repeated (or skipped for time compression) is one feature that may be provided by the present invention and is discussed in greater detail below.

Figure 3B:
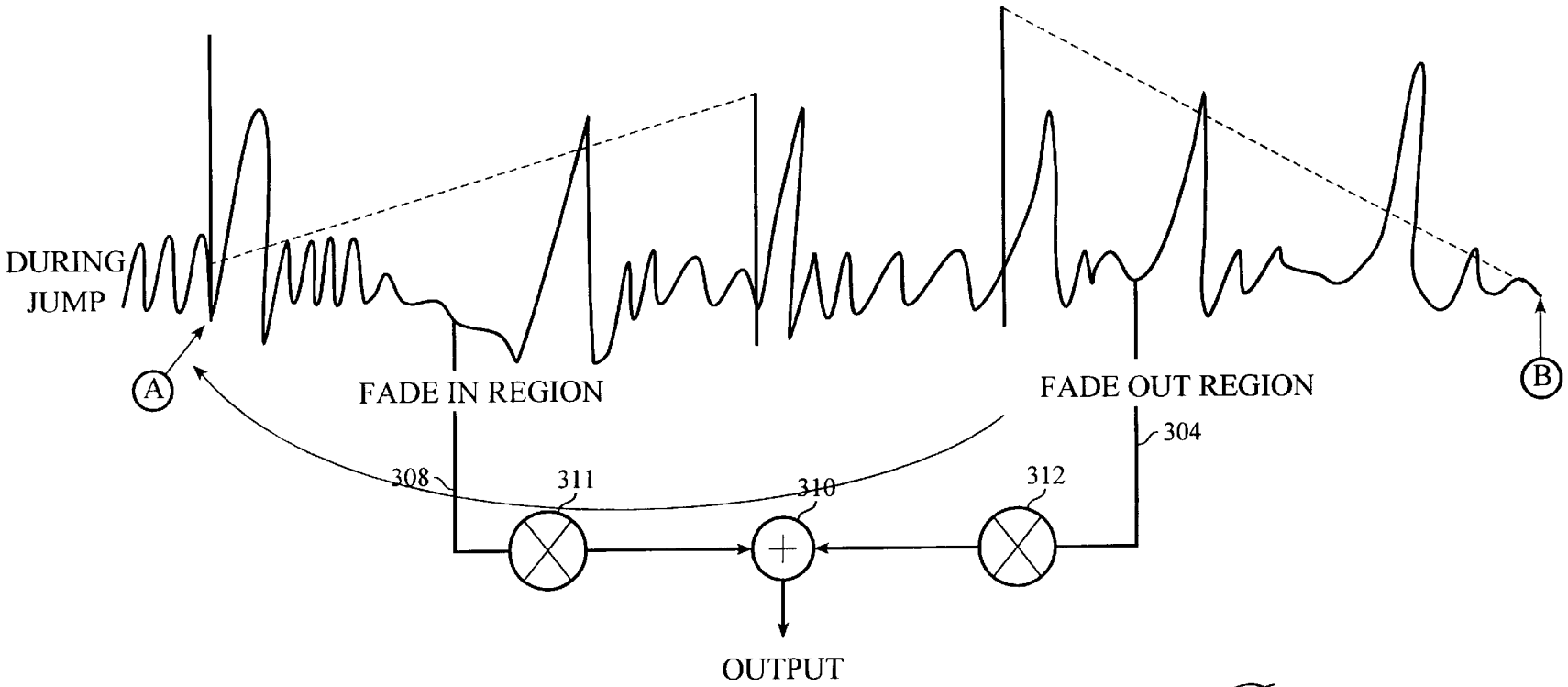

FIG. 3B depicts the use of cross-fading to repeat segments. Current read pointer 304 becomes a read pointer into a fade-out region and continues to increment a the sample rate. A new fade-in read pointer 308 is generated at the beginning of the segment to be repeated. New fade-in read pointer 308 also increments at the sampling rate. New fade-in read pointer 308 does not immediately replace current read pointer 304. Rather, during a cross-fade period, the output is a weighted sum of the value in the location pointed to by read pointer 308 and the value in the location pointed to by read pointer 304 as obtained by a summer 310. Multipliers 312 apply the weighing. At the beginning of the cross-fade, the weight on read pointer 304 is high and the weight on read pointer 308 is low. As the cross-fade continues, the weight on read pointer 308 increases as the weight on read pointer 304 decreases.

Figure 3C:
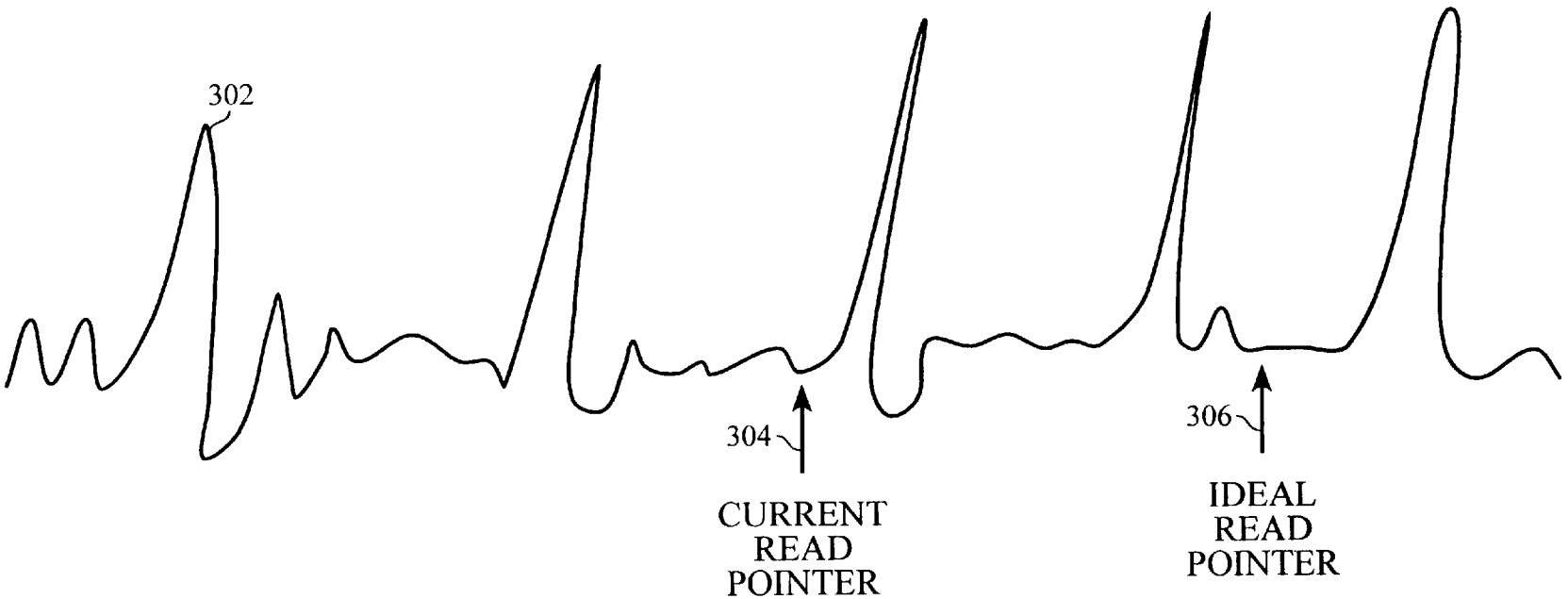

FIG. 3C depicts the situation at the completion of the cross-fade. Cross-fade read pointer 308 becomes the new current read pointer and continues to increment at the sampling rate. Ideal read pointer 302 continues to increment at 1/R times the sampling rate. FIGS. 3A–3C depict repeating a segment for the purpose of time stretching but segment skipping for time compression occurs in the same way except that the new fade-in pointer is started ahead of the current read pointer rather than behind it.

Figure 4:
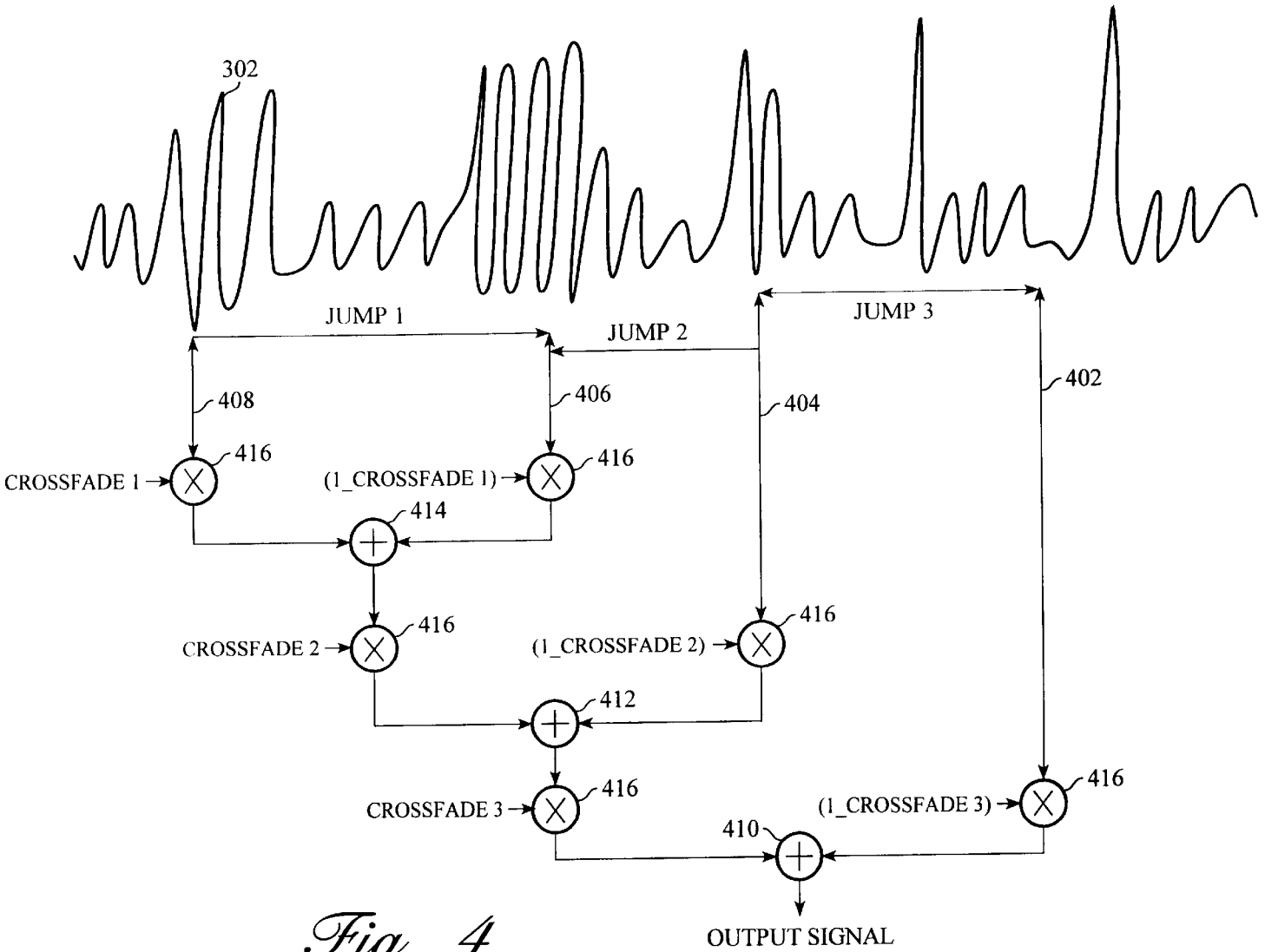
FIG. 4 depicts multiple cross-fading.

During the operation of the splice method, it may be desirable to begin a new cross-fade to repeat or skip a segment before a previous cross-fade is completed. FIG. 4 depicts multiple cross-fading. FIG. 4 shows three cross-fades occurring simultaneously. A jump3 occurred before a jump2 which in turn occurred before a jump1. A read pointer 402 represents the original current read pointer. Read pointers 404 and 406 represent the destinations of the previous two jumps. A read pointer 408 is the destination of the final jump, jump1. The current output is obtained from a summer 410. After, the cross-fade for jump3 ends, the output will be obtained from a summer 412. When the cross-fade for jump2 also ends, the output will be obtained from a summer 414. Eventually, after all three cross-fades end, the output is pointed to by read pointer 408. This scenario of course assumes that no new jumps occur in the interim. Weighing for the cross-fades is performed by multipliers 416.

In one embodiment, the present invention is directed toward method and apparatus for determining the position and duration (length) of segments to skip or repeat in the context of the splice method discussed with reference to FIGS. 3A–3C and FIG. 4. Segments within strictly periodic portions of the signal are favored to be skipped or repeated to make the skipping or repeating operation less conspicuous. Furthermore, this embodiment avoids skipping or repeating segments with transients for the same reason.

Preferably, the periodicity and presence of transients are evaluated on a piecewise basis for the signal. A particular piece of the signal is placed in a buffer. This piece is analyzed for periodicity and transients. This analysis preferably occurs before the current read pointer reaches the piece to be analyzed. In one embodiment, each piece is 40 milliseconds long. Preferably, the pieces overlap so that the analysis occurs every 5 milliseconds. Also, a time discrepancy counter is maintained to track the difference between the current read pointer and the ideal read pointer. The counter is not allowed to exceed a limit.

Figure 5:
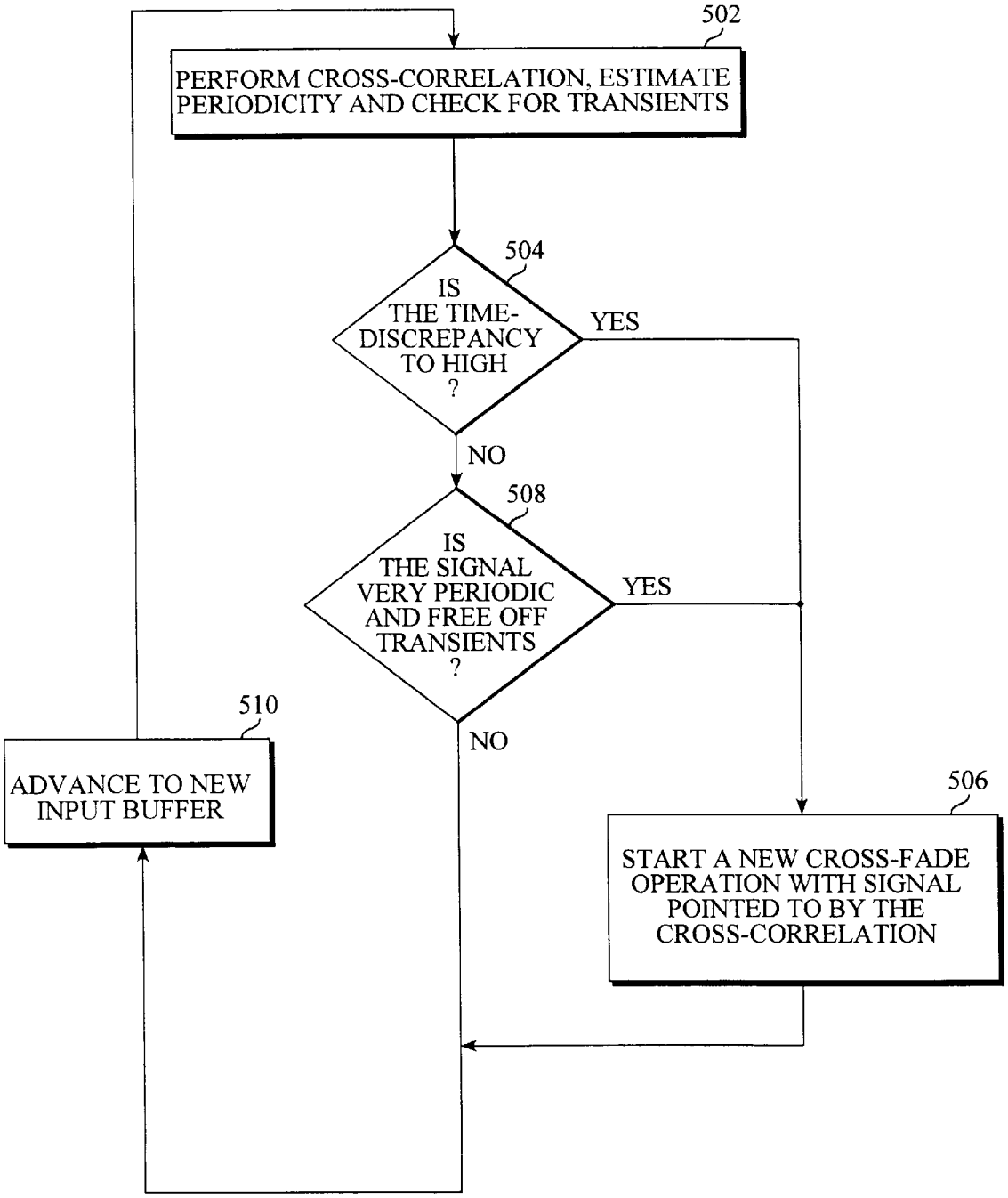
FIG. 5 is a flowchart describing steps of determining the position and duration of a segment to be repeated in accordance with one embodiment of the present invention.

FIG. 5 is a flowchart describing steps of determining the position and duration of a segment to be skipped or repeated in accordance with one embodiment of the present invention. FIG. 5 assumes ongoing movement of the current read pointer and the ideal read pointer as was explained with reference to FIGS. 3A–3C and FIG. 4. The steps of FIG. 5 determine where to initiate cross-fades and over how long a segment. Analysis of the signal takes place within a buffer which holds samples somewhat ahead of both the current and ideal read pointers.

At step 502, the buffer is analyzed to determine the periodicity of the signal piece currently held in the buffer as measured over a range of possible periods. In accordance with the present invention, periodicity is determined by evaluating a normalized cross-correlation over the buffer. Transients are evaluated by comparing the rms values of groups of samples within the buffer. A variation in rms value from one group of samples to the next in excess of the threshold represents a transient that should not be skipped or repeated. At step 504, the preferred embodiment checks the current value of the time discrepancy counter. If the time discrepancy counter is above a maximum tolerable discrepancy, e.g., from 10–50 milliseconds, a cross-fade is initiated to skip or repeat a segment at step 506, regardless of any transients present or periodicity characteristics. The segment will include the current buffer. If the segment is to be skipped for time stretching, the cross-fade will begin when the current read pointer reaches the first sample in the currently analyzed buffer. If the segment is to be repeated for time stretching, the cross-fade will begin when the current read pointer reaches the last sample in the currently analyzed buffer. The length of the segment to be skipped or repeated will be equivalent to the period found in step 502 to provide the maximum periodicity measurement.

If the time discrepancy is below the maximum tolerable discrepancy, the preferred embodiment proceeds to step 508 where the periodicity and transient information obtained in step 502 is considered. If the maximum periodicity over the range of possible periods is above a periodicity threshold, the segment that would be skipped or repeated does not encompass a transient, and skipping or repeating this segment would not create a discrepancy greater than the maximum tolerable discrepancy, the preferred embodiment proceeds to step 506. To determine whether the segment to be skipped or repeated encompasses a transient, step 508 may need to review a list of transients located in previous buffers. After step 506, or after a negative determination in step 508, the preferred embodiment proceeds to step 510 to iterate to the next buffer.

Figure 6A:
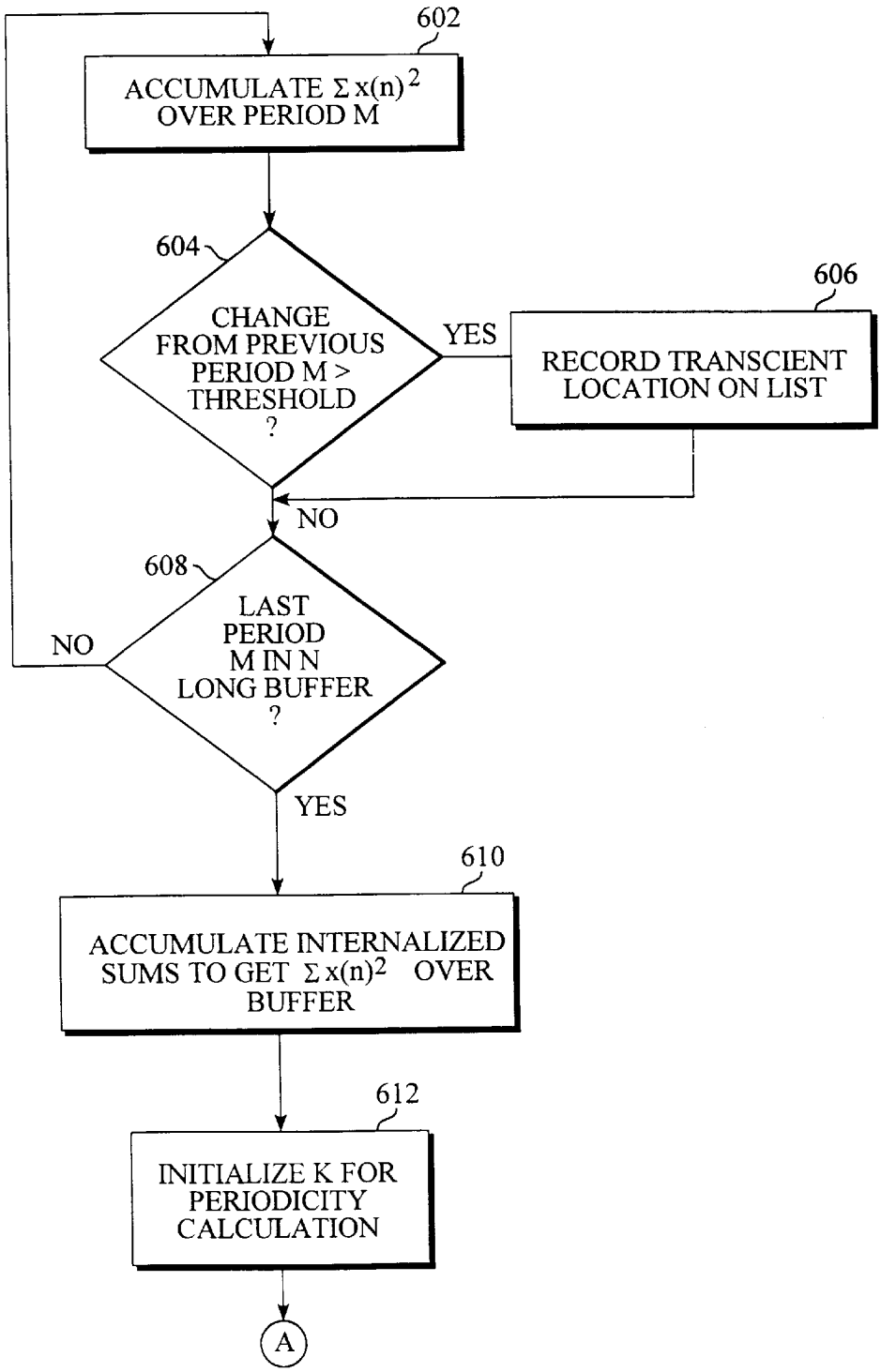
FIGS. 6A–6B depict a flowchart describing steps of estimating periodicity and identifying transients in accordance with one embodiment of the present invention.
Figure 6B:
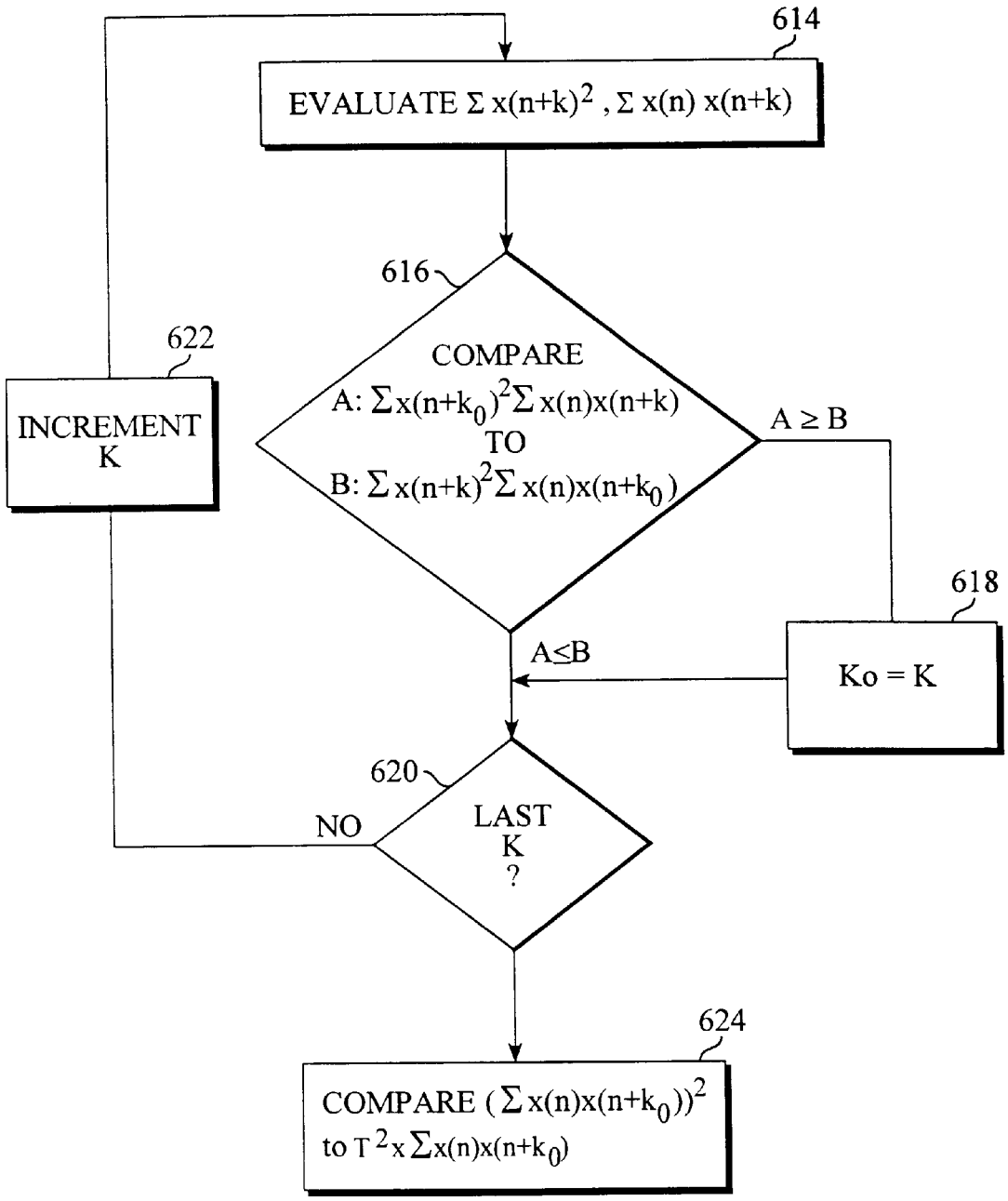

FIGS. 6A–6B depict a flowchart describing steps of estimating periodicity and identifying transients in accordance with one embodiment of the present invention. The steps of FIGS. 6A–6B implement step 502 of FIG. 5, evaluating periodicity and identifying transients in a buffer. In the preferred embodiment, one buffer holds a 40 millisecond piece of the signal. Preferably, the signal has been previously sampled at 44100 Hz to 48000 Hz. Herein, the number of samples within the buffer will be referred to as N. Step 602 begins an iterative process to identify transients in the buffer. At step 602, the preferred embodiment evaluates the means square amplitude over a sub-period of M samples according to the formula, $$\sum_{n=0}^{M-1} x(n)^2,$$

where x(n) is the signal value at a position n in the buffer. The mean square is evaluated rather than the root mean square to avoid a square root calculation while identifying the same transients as a root mean square evaluation would. In the preferred embodiment, M corresponds to approximately 5 milliseconds of samples.

At step 604, this mean square is compared to the mean square amplitude accumulated for the previous period of M samples. If the current mean square amplitude exceeds the previous mean square amplitude by more than a threshold, preferably a factor of 1.7, then a transient at this location is noted at step 606 on a transient locator list. If this threshold is not exceeded, or after step 606, the preferred embodiment checks if mean square amplitude has been evaluated for every period of M samples in the buffer at step 608. If every period of M samples has not been evaluated, the preferred embodiment returns to step 602 to process the next period of M samples. If every period of M samples has been evaluated, transient checking for the buffer is complete and execution proceeds to step 610.

At step 610, the preferred embodiment accumulates the mean squares calculated for every period of M samples to form the sum $$\sum_{n=0}^{M-1} x(n)^2$$

for the entire buffer. This quantity is useful later in comparing periodicity to a periodicity threshold. The periodicity of the samples in the current buffer is evaluated over a range of periods k using the normalized cross-correlation given by $$R(K) = \frac{\sum_{n=0}^{N-1} x(n)x(n+k)}{\left(\sum_{n=O}^{N-1} x(n)^2 \sum_{n=0}^{N-1} x(n+k)^2\right)^{1/2}}.$$

At step 612, k is initialized to a minimum value, preferably the value of k corresponding to approximately 5 milliseconds. Rather than evaluating the cross-correlation formula directly which would require a division for each iteration of k, the preferred embodiment evaluates $$\left(\sum_{n=0}^{N-1} x(n)x(n+k)\right)^2 \text{ and}$$

$$\sum_{n=0}^{N-1} x(n+k)^2$$

at step 614. Step 614 is the beginning of an iterative process to find the value of k for which the periodicity is highest. It is understood that for certain values of (n+k), the value of x(n+k) will come from outside the current buffer. During and after the iterative process, $k_0$ is the value of k having the highest periodicity evaluated so far for the buffer.

At step 616, the quantity $$\sum_{n=0}^{N-1} x(n+k_o)^2 \left(\sum_{n=0}^{N-1} x(n)x(n+k)\right)^2 * \text{sign}\left(\sum_{n=0}^{N-1} \chi(n)\chi(n+k)\right)$$

where $$\text{sign}(x) = \begin{cases} 1 \text{ if } x \geq 0 \\ -1 \text{ if } x < 0 \end{cases}$$

is compared to the quantity $$\sum_{n=0}^{N-1} x(n+k)^2 \left( \sum_{n=0}^{N-1} x(n)x(n+k_o) \right)^2 * \text{sign} \left( \sum_{n=0}^{N-1} x(n)x(n+k_o) \right)$$

for the current value of k. It can be shown that this comparison is equivalent to comparing the normalized cross-correlation for the current value of k to the normalized cross-correlation for $k_0$. If the quantity $$\sum_{n=0}^{N-1} x(n+k_o)^2 \left( \sum_{n=0}^{N-1} x(n)x(n+k) \right)^2 * \text{sign} \left( \sum_{n=0}^{N-1} \chi(n)\chi(n+k) \right)$$

is greater, than $k_0$ is set to k at step 618 because the current value of k gives the maximum periodicity. If not, or after step 618, the preferred embodiment checks if the current k is the highest k to be checked at step 620, preferably corresponding to 30–50 milliseconds. If further values of k remain, k is incremented at step 622 and another iteration begins at step 614. If no further values of k remain, the current value of $k_0$ represents the period value giving the maximum periodicity.

At step 624, the preferred embodiment checks whether this periodicity value is greater than the threshold, T, that would cause a segment to be skipped or repeated. To avoid a division, rather than directly compare the normalized cross-correlation value to T directly, the quantity $$\left( \sum_{n=0}^{N-1} x(n)x(n+k_o) \right)^2$$

is compared to $$T^2 \sum_{n=O}^{N-1} x(n)^2 \sum_{n=O}^{N-1} x(n+k_o)^2$$

If $$\left( \sum_{n=0}^{N-1} x(n)x(n+k_o) \right)^2$$

is greater, then the periodicity value for $k_0$ is greater than the threshold for skipping or repeating. It should be noted that time is saved in step 624 because $$\sum_{n=0}^{N-1} x(n)^2$$

has already been computed at step 610 from the transient analysis results.

Thus, the results of FIGS. 6A–6B include a list of transients within the current buffer, a value of k for which the periodicity is maximum for the samples within the buffer, and a decision as to whether this maximum periodicity exceeds the threshold for skipping or repeating a segment.

Figure 7:
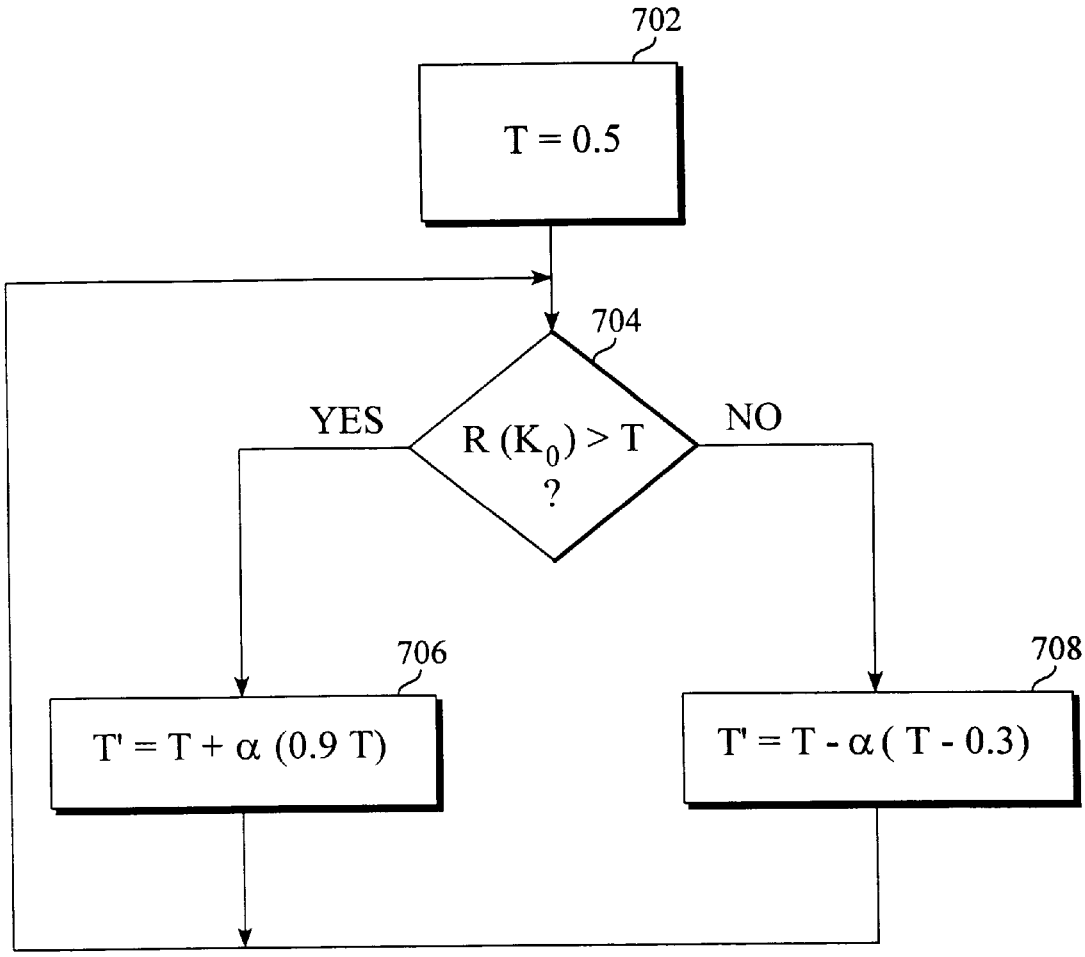
FIG. 7 is a flowchart describing steps of adaptively varying a periodicity threshold in accordance with one embodiment of the present invention.

FIG. 7 is a flowchart describing steps of adaptively varying a periodicity threshold in accordance with one embodiment of the present invention. The periodicity threshold T is varied adaptively to take into account varying signal conditions. At step 702, T is initially set to 0.5. Step 704 duplicates the comparison of step 624 to establish whether the maximum periodicity for the current buffer exceeds T. If the maximum periodicity exceeds T, the threshold to be used for the next buffer, T', is set to equal $T+\alpha[0.9-T]$ at step 706. If this maximum periodicity does not exceed T, T' is set to equal $T-\alpha[T-0.3]$ at step 708. Step 704 and either step 706 or step 708 repeats for each succeeding buffer. $\alpha$ controls the responsiveness of adaptation and is preferably set to approximately 0.2. T thus varies between 0.3 and 0.9.

Source code written in the C language for implementing elements of the present invention is included in the appendix included herewith. After compilation and linking using software available from Texas Instruments, the source code will run on the TMS320C32 digital signal processor.

The above description is illustrative and not restrictive. Many variations of the invention will become apparent to those of skill in the art upon review of this disclosure. Merely by way of example, while the invention has been illustrated primarily with regard to a signal processing system, a conventional computer system could also be utilized. The scope of the invention should, therefore, be determined not with reference to the above description, but instead should be determined with reference to the appended claims along with their full scope of equivalents.

SOURCE CODE APPENDIX
TIME-DOMAIN TIME/PITCH SCALING OF SPEECH
OR AUDIO SIGNALS, WITH TRANSIENT HANDLING
Copyright (c) 1996
E-mu Systems Proprietary All rights Reserved.

```
/* FindOptimalJump () calculates the autocorrelation of a signal, find
 * its maximum, detects transients and checks whether the maximum of the
 * autocorrelation is above a threshold. Returns 0 when it's better to not
 * jump, based on the value of the periodicity, or the length of the jump in
 * samples.
 * Input variables:
 * InputSignal:        An array containing the input signal.
 * Power:              An array where the power values are stored.
 * AutoCorrelation:    An array where the autocorrelation is stored.
```

-continued

SOURCE CODE APPENDIX
TIME-DOMAIN TIME/PITCH SCALING OF SPEECH
OR AUDIO SIGNALS, WITH TRANSIENT HANDLING
Copyright (c) 1996
E-mu Systems Proprietary All rights Reserved.

```
 * Transient:          A pointer to a transient indicator.
 * DoIt:                   Indicates whether jumping is mandatory or not.
 * MinJumpLength:      The minimum length of a jump.
 * MaxJumpLength:      The maximum length of a jump.
 * AutocorrLength:     The length over which the correlation is calculated.
 */
int FindOptimalJump(float* InputSignal, float* Power, float*
AutoCorrelation, int* Transient, int DoIt, int MinJumpLength,
int MaxJumpLength, int AutocorrLength)
{
        int i,j;
        float *PointerToSignal;
        float *PointerToShiftedSignal;
        float *PointerToAutocorr;
        float *PointerToPower;
        int MaxAutocorrLag:
        int NumberOfAutocorrLag;
        float MaxPower, MaxAutocorrValue;
        float Power0, LastPower;
        float *foo;
        float Tempfloat;
        static float PowerMemory = 0.0;
        static float TreshMemory = 0.5;
/* First, calculate the power corresponding to the lag 0 */
/* Power0 corresponds to the power of the non-shifted signal. */
        PointerToPower = Power;
        LastPower = 0;
        PointerToSignal = InputSignal+MinJumpLength;
        for (j=0; j<AutocorrLength; j++, PointerToSignal++)
            LastPower += *PointerToSignal * *PointerToSignal;
   PointerToSignal = InputSignal;
   for (j=0, Power0=0; j<AutocorrLength; j++, PointerToSignal++)
        Power0 += *PointerToSignal * *PointerToSignal;
        MaxPower = LastPower;
/*_____________________________________________________________*/
/* Transient detection scheme. If the energy is more than
 * a threshold times the energy in the preceding frame, we decide that's a
 * transient. Not very smart indeed.
 */
        if (Power0 > PowerMemory * 1.5)
            *Transient = 1;
        PowerMemory = Power0;
/* Then start looping over autocorrelation lags */
     NumberOfAutocorrLag = MaxJumpLength − MinJumpLength;
        PointerToAutocorr = AutoCorrelation;
        for (i = 0, MaxAutocorrValue = 0, MaxAutocorrLag = 0;
                i < NumberOfAutocorrLag; i++)
        {
            PointerToSignal = InputSignal:
            PointerToShiftedSignal =
                InputSignal+MinJumpLength+i;
                /*          To calculate the power of the signal, use previous
                 * value then subtract the leftmost square in the previous value, and
                 * add the rightmost square in the present value.
                 */
                foo = PointerToShiftedSignal+AutocorrLength−1;
                LastPower += *foo * *foo − *(PointerToShiftedSignal−1) *
                    *(PointerToShiftedSignal−1);
                *PointerToPower = LastPower;
                Tempfloat = 0;
            for (j = 0; j < AutocorrLength; j++)
                Tempfloat += *PointerToSignal++ * *PointerToShiftedSignal++;
                *PointerToAutocorr = Tempfloat;
                if (*PointerToAutocorr < 0)
                    *PointerToAutocorr *= − *PointerToAutocorr;
            else
                {
                    *PointerToAutocorr *= *PointerToAutocorr;
                    if (MaxAutocorrValue * *PointerToPower <
                            *PointerToAutocorr * MaxPower)
                    {
                        MaxAutocorrValue = *PointerToAutocorr;
                        MaxAutocorrLag = i;
```

-continued

SOURCE CODE APPENDIX
TIME-DOMAIN TIME/PITCH SCALING OF SPEECH
OR AUDIO SIGNALS, WITH TRANSIENT HANDLING
Copyright (c) 1996
E-mu Systems Proprietary All rights Reserved.

```
                    MaxPower = *PointerToPower;
                }
            }
        PointerToAutocorr++;
        PointerToPower++;
    } /* i */
    NumberOfAutocorrLag = MaxJumpLength - MinJumpLength;
/*_____________________________________________________*/
/* DoIt tells us whether we should jump at any cost or not. If we don't have
 * to jump (DoIt = 0), then we won't jump unless the cross correlation is high
 * enough, and the two segments have about the same amplitude.
 */
    if (DoIt <= 0)      /* Jumping is not mandatory */
    {
            if (MaxAutocorrValue <
                TreshMemory * Power[MaxAutocorrLag] * Power0)
            {
                TreshMemory = TreshMemory - 0.2 * (TreshMemory - 0.3);
                return(0);
            }
            else /* DoIt = 0 and all conditions are met! Increase threshold. */
            TreshMemory = TreshMemory + 0.2 * (0.8 - TreshMemory);
    }
    else                /* Jump mandatory */
    {
    /* Decrease threhold if necessary. */
    if(MaxAutocorrValue < TreshMemory * Power[MaxAutocorrLag) * Power0)
            TreshMemory = TreshMemory - 0.2 * (TreshMemory - 0.3);
    else
            TreshMemory = TreshMemory + 0.2 * (0.8 - TreshMemory);
    }
    return (MaxAutocorrLag):
```

What is claimed is:

1. A method of operating a computer to compress a duration of an audio signal comprising the steps of:

providing an audio signal;

evaluating periodicity of segments of said audio signal based on normalized cross-correlation evaluated over a range of periods;

selecting a position of a segment of said audio signal to be skipped, said segment being positioned within a highly periodic portion of said audio signal as determined by said evaluating step; and selecting a length of said segment to be skipped to correspond to a period having a maximum normalized cross-correlation as determined in said evaluating step.

2. The method of claim 1 further comprising the step of identifying transients in said audio signal above a predetermined threshold, wherein said position is selected so that said segment to be skipped includes no identified transients.

3. The method of claim 2 further comprising the step of: removing said segment to be skipped.

4. The method of claim 3 further comprising the step of: resampling said audio signal to restore an original duration of said signal, thereby shifting a pitch content of said audio signal.

5. The method of claim 2 further including an augmenting step comprising:

cross-fading said segment to be repeated into said audio signal.

6. The method of claim 5 wherein said normalized cross-correlation is given by:

$$R(K) = \frac{\sum_{n=0}^{N-1} x(n)x(n+k)}{\left(\sum_{n=O}^{N-1} x(n)^2 \sum_{n-0}^{N-1} x(n+k)^2\right)^{1/2}},$$

wherein x(n) represents a value of said audio signal at a time n relative to a beginning of a selected piece of said audio signal, k representing a possible period of said range, N representing a predetermined number of samples.

7. The method of claim 6 wherein said identifying step comprises:

computing $$\sum_{n=0}^{M-1} x(n)^2$$

as an indicator of rms value wherein M represents a predetermined number of samples, variations in said rms value indicator over a first threshold constituting a transient.

8. The method of claim 7 wherein said selecting a position step comprises identifying a piece of said audio signal for which said normalized cross-correlation exceeds a second threshold for some value $k_0$ of k.

9. The method of claim 8 wherein said normalized cross-correlation is compared to said second threshold by comparing $$\left(\sum_{n=0}^{N-1} x(n)x(n+k_o)\right)^2$$

to $$T^2 \sum_{n=O}^{N-1} x(n)^2 \sum_{n=O}^{N-1} x(n+k_o)^2,$$

wherein T is said second threshold.

10. The method of claim 8 wherein a previous maximum normalized cross-correlation for a period $k_0$ is compared to a prospective new maximum normalized cross-correlation for a period k by comparing $$\sum_{n=0}^{N-1} x(n+k_o)^2 \left(\sum_{n=0}^{N-1} x(n)x(n+k)\right)^2 * \text{sign}\left(\sum_{n=0}^{N-1} \chi(n)\chi(n+k)\right)$$

where $$\text{sign}(x) = \begin{cases} 1 \text{ if } x \geq 0 \\ -1 \text{ if } x < 0 \end{cases}$$

to $$\sum_{n=0}^{N-1} x(n+k)^2 \left(\sum_{n=0}^{N-1} x(n)x(n+k_o)\right)^2 * \text{sign}\left(\sum_{n=0}^{N-1} x(n)x(n+k_o)\right).$$

11. The method of claim 10 wherein $$M < N \text{ and } \sum_{n=0}^{N-1} x(n)^2$$

is obtained by accumulating the values of said rms value indicators, $$\sum_{n=0}^{M-1} x(n)^2.$$

12. A method of operating a computer to extend a duration of an audio signal comprising the steps of:

providing an audio signal;

evaluating periodicity of segments of said audio signal based on normalized cross-correlation evaluated over a range of periods;

selecting a position of a segment of said audio signal to be repeated, said segment being positioned within a highly periodic portion of said audio signal as determined by said evaluating step; and selecting a length of said segment to be repeated to correspond to a period having a maximum normalized cross-correlation as determined in said evaluating step.

13. The method of claim 12 further comprising the step of identifying transients in said audio signal above a predetermined threshold, wherein said segment is positioned by said selecting a position step to include no identified transients.

14. The method of claim 13 further comprising the step of: augmenting said audio signal by repeating said segment to be repeated.

15. The method of claim 14 further comprising the step of: resampling said audio signal to restore an original duration of said signal, thereby shifting pitch content of said audio signal.

16. The method of claim 13 further including an augmenting step comprising:

cross-fading said segment to be repeated into said audio signal.

17. The method of claim 16 wherein said normalized cross-correlation is given by:

$$R(K) = \frac{\sum_{n=0}^{N-1} x(n)x(n+k)}{\left(\sum_{n=O}^{N-1} x(n)^2 \sum_{n=0}^{N-1} x(n+k)^2\right)^{1/2}},$$

wherein x(n) represents a value of said signal at a time n relative to a beginning of a selected piece of said signal, k representing a possible period of said range, N representing a predetermined number of samples.

18. The method of claim 17 wherein said identifying step comprises:

computing $$\sum_{n=0}^{M-1} x(n)^2$$

as an indicator of rms value wherein M represents a predetermined number of samples, variations in said rms value indicator over a first threshold constituting a transient.

19. The method of claim 18 wherein said selecting a position step comprises identifying a piece of said audio signal for which said normalized cross-correlation exceeds a second threshold for some value $k_0$ of k.

20. The method of claim 19 wherein said normalized cross-correlation is compared to said second threshold by comparing $$\left(\sum_{n=0}^{N-1} x(n)x(n+k_o)\right)^2$$

to $$T^2 \sum_{n=O}^{N-1} x(n)^2 \sum_{n=O}^{N-1} x(n+k_o)^2,$$

wherein T is said second threshold.

21. The method of claim 19 wherein a previous maximum normalized cross-correlation for a period $k_0$ is compared to a prospective new maximum normalized cross-correlation for a period k by comparing $$\sum_{n=0}^{N-1} x(n+k_o)^2 \left(\sum_{n=0}^{N-1} x(n)x(n+k)\right)^2 * \text{sign}\left(\sum_{n=0}^{N-1} \chi(n)\chi(n+k)\right)$$

where $$\text{sign}(x) = \begin{cases} 1 \text{ if } x \geq 0 \\ -1 \text{ if } x < 0 \end{cases}$$

to $$\sum_{n=0}^{N-1} x(n+k)^2 \left( \sum_{n=0}^{N-1} x(n)x(n+k_o) \right)^2 * \text{sign} \left( \sum_{n=0}^{N-1} x(n)x(n+k_o) \right).$$

22. The method of claim 21 wherein $$M < N \text{ and } \sum_{n=0}^{N-1} x(n)^2$$

is obtained by accumulating the values of said rms value indicators, $$\sum_{n=0}^{M-1} x(n)^2.$$

23. A computer program product for compressing duration of a signal comprising:

code for evaluating periodicity of segments of said signal based on normalized cross-correlation evaluated over a range of periods;

code for selecting a position of a segment of said signal to be skipped, said segment being positioned within a highly periodic portion of said signal as determined by said evaluating step;

code for selecting a length of said segment to be skipped to correspond to a period having a maximum normalized cross-correlation as determined in said evaluating step; and a computer-readable storage medium for storing the codes.

24. A computer program product for extending duration of a signal comprising:

code for evaluating periodicity of segments of said signal based on normalized cross-correlation evaluated over a range of periods;

code for selecting a position of a segment of said signal to be repeated, said segment being positioned within a highly periodic portion of said signal as determined by said evaluating step;

code for selecting a length of said segment to be repeated to correspond to a period having a maximum normalized cross-correlation as determined in said evaluating step; and a computer-readable storage medium for storing the codes.

25. A computer system configured to compress duration of a signal, said computer system comprising:

a central processing unit; and a memory storing code for execution by said central processing unit, said code comprising:

code for evaluating periodicity of segments of said signal based on normalized cross-correlation evaluated over a range of periods;

code for selecting a position of a segment of said signal to be skipped, said segment being positioned within a highly periodic portion of said signal as determined by said evaluating step; and code for selecting a length of said segment to be skipped to correspond to a period having a maximum normalized cross-correlation as determined in said evaluating step.

26. A computer system configured to extend duration of a signal, said computer system comprising:

a central processing unit; and a memory storing code for execution by said central processing unit, said code comprising:

code for evaluating periodicity of segments of said signal based on normalized cross-correlation evaluated over a range of periods;

code for selecting a position of a segment of said signal to be repeated, said segment being positioned within a highly periodic portion of said signal as determined by said evaluating step; and code for selecting a length of said segment to be repeated to correspond to a period having a maximum normalized cross-correlation as determined in said evaluating step.

27. The computer program product of claim 23 further including code for identifying transients in said signal above a predetermined threshold, wherein said position is selected so that said segment to be skipped includes no identified transients.

28. The computer program product of claim 24 further including code for identifying transients in said signal above a predetermined threshold, wherein said position is selected so that said segment to be skipped includes no identified transients.

29. The computer system of claim 25 further including code for identifying transients in said signal above a predetermined threshold, wherein said position is selected so that said segment to be skipped includes no identified transients.

30. The computer system of claim 26 wherein said memory further includes code for identifying transients in said signal above a predetermined threshold, wherein said position is selected so that said segment to be skipped includes no identified transients.

* * * * *